United States Patent [19]

Bassett

[11] Patent Number: 4,825,611

[45] Date of Patent: May 2, 1989

[54] DRAPERY ROD ASSEMBLY FOR ARCHITECTURAL APERATURES

[76] Inventor: Deborah K. Bassett, 5703 Ben Casey, San Antonio, Tex. 78240

[21] Appl. No.: 104,781

[22] Filed: Oct. 2, 1987

[51] Int. Cl.[4] ..... E04B 1/00

[52] U.S. Cl. ..... 52/222; 52/204; 160/372; 160/84.1; 211/105.3; 248/263

[58] Field of Search ..... 160/84 R, 372, 377, 160/354, 350, 134; 52/222, 204; 211/105.3; 248/263, 253

[56] References Cited

U.S. PATENT DOCUMENTS

| | | | |
|---|---|---|---|
| 22,521 | 1/1859 | Warner et al. | 160/330 |
| 269,880 | 1/1883 | Rawlings | 160/330 |
| 533,152 | 1/1895 | Wheat | 160/330 |
| 1,380,661 | 6/1921 | Leininger | 160/354 X |
| 1,609,877 | 12/1926 | Kendall | 160/84.1 |
| 2,255,990 | 9/1941 | Stratton | 156/22 |
| 2,261,141 | 11/1941 | Davis | 160/354 X |
| 2,504,821 | 4/1950 | Fowler | 211/105.2 |
| 2,790,558 | 1/1955 | Rosenbaum | 211/105.2 |
| 2,890,799 | 6/1959 | Rosenbaum | 211/105.2 |
| 3,437,127 | 4/1969 | Lukashok | 160/330 |
| 4,635,889 | 1/1987 | Bell et al. | 211/105.2 |

FOREIGN PATENT DOCUMENTS

| | | | |
|---|---|---|---|
| 40057 | 10/1886 | Fed. Rep. of Germany | 160/330 |

*Primary Examiner*—Blair M. Johnson
*Attorney, Agent, or Firm*—David G. Henry

[57] ABSTRACT

A drapery assembly for use in architectural apertures having non-standard sizes and shapes, such as arched windows. The traverse rod portion of the assembly is a flexible, telescopic rod formed from tube sections of synthetic plastic-like material. The rod is supported along the upper boundary of the aperture by a plurality of hooks which aid in maintaining the rod in a desired orientation. A drapery is made to maintain the rod in substantial conformity with the shape of the aperture without aid of the hooks thereby facilitating installation of the assembly one hooks are in place. The variable size of the rod permits the assembly to be used in apertures of differing sizes. The material forming the rod makes the rod easily bent to have a uniform curvature and to conform to the shape of the aperture. The material also insures that the fabric forming the drapery contacts only smooth surfaces thereby preventing snagging.

12 Claims, 2 Drawing Sheets

DRAPERY ROD ASSEMBLY FOR ARCHITECTURAL APERATURES

BACKGROUND OF THE INVENTION

1. Field of the Invention

The present invention relates to hardware for supporting draperies in windows and similar architectural features.

2. Description of the Prior Art

Since well before modern times, architectural apertures (windows and passageways) in homes and buildings have featured curved perimeters, the arched window being a common example. Frequently, plans for the interior design of a home or building having such apertures calls for draperies to fill or cover all or part of the apertures. When the portion to be covered is bounded, at least in part, by curved surfaces, such as when the uppermost portion of an arched window is to be covered, standard curtain rods cannot be used.

Prior to the present invention, a suitable apparatus for supporting a drapery along a curved perimeter constituted a specially designed and manufactured traverse rod assembly made to conform to the specific dimensions of the particular architectural aperture in which a drapery was to be installed. In addition to the expense involved in having a unique curtain rod assembly designed and manufactured, errors in manufacturing, damage in transit and/or faulty installation often rendered such a curtain rod assembly unusable or unsightly.

Inexpensive alternatives to specially fabricated curtain rod assemblies have been proposed. Such seemingly economical alternatives have proven to be unacceptable in practice, however. For example, U.S. Pat. No. 2,255,990 issued to P. Stratton discloses a curtain rod bracket assembly which is designed for supporting a standard curtain rod in a curved orientation. As those experienced in use of such standard curtain rods are aware, little more than the slightest bending of a standard curtain rod will result in buckling in one or more places along the rod. Further, even if the rod does not buckle, a uniform curvature is nearly impossible to achieve using a standard curtain rod with the bracket assembly shown in the Stratton patent.

U.S. Pat. Nos. 2,790,558 and 2,890,799 issued to H. Rosenbaum each disclose a flexible traverse rod for conforming to curved window or passageway perimeters. The Rosenbaum traverse rods are shown made of a channel-shaped metallic member with a plurality of slots formed in the intended convex side of the traverse rod. These slots permit the metallic member to be formed into a curved shape with the slots opening at their apex to evenly distribute the deformation along the metallic member and thereby achieve an acceptably uniform curvature.

A serious limitation of the Rosenbaum constitution traverse rods relates to the presence of the slots. The slots formed in the metallic member produce sharp edges and corners which, when coming into contact with the expensive drapery fabric, tends to snag or tear the fabric. This not only damages the fabric, but makes threading the drapery onto the rod very difficult.

It would, therefore, be advantageous to devise an apparatus and/or a method for installing draperies in windows or passageways having curved boundaries, which apparatus or method would provide a substantially economical alternative to specially designed and manufactured curtain rod assemblies and to the undesirable alternatives to such curtain rod assemblies which have been shown in the prior art.

SUMMARY OF THE INVENTION

It is an object of the present invention to provide means for suspending drapery in an architectural aperture.

It is another object of the present invention to provide means for suspending drapery in an architectural aperture having curved boundaries, which drapery suspending means is designed for conforming to the aperture's curved boundaries.

It is yet another object of the present invention to provide inexpensive means for suspending drapery in an architectural aperture having curved boundaries, which means need not be specially fabricated for the particular intended aperture, is maintained in a desired orientation over its entirety, does not involve materials coming into contact with drapery fabric which may damage the fabric, and which, because of materials used, easily conforms to the shape of the architectural aperture.

It is still another object of the present invention to provide a simple and inexpensive method for suspending drapery in an architectural aperture.

In accordance with these objects, the present invention comprises an inexpensive and easily fashioned drapery assembly and method for installing drapery in architectural apertures having curved boundaries whereby the drapery is supported and maintained to conform to the shape of its recipient aperture.

The drapery assembly comprises a plurality of hooks which are to be installed in the building material at the periphery of an architectural aperture, the hooks being installed such that they face a like direction perpendicular to the plane of the aperture. The assembly further comprises a first flexible rod member having a diameter and length for extending through the eye of each hook and thereby conforming to the shape of the portion of the window which is to be covered. The first rod is made from two or more sections of synthetic, plastic, smooth surfaced tubing which are telescopically engaged. A second rod which is substantially inflexible is joined with the flexible rod by means of elbow joints which are affixed to the surrounding building material. The second rod is formed either from a thicker form of the material used for the first rod whereby it is not flexible, or from a different material so long as it is still smooth surfaced.

Appropriately sized and sewn drapery material is supported by the rod which, in turn, is supported by the hooks. The smooth surfaced rods insure that drapery fabric will not be damaged as it comes into contact with the rods. The hooks, as opposed to mounting hardware which merely supports a rod at either end, insure that the first rod stays in conformity with the shape of the window along the first rod's entire length. The nature of the material forming the first rod is that it curves uniformly between points where pressure is applied to it, therefore it is particularly useful for achieving a uniform curvature for arched windows.

DETAILED DESCRIPTION OF THE PREFERRED EMBODIMENT

Figure 1:
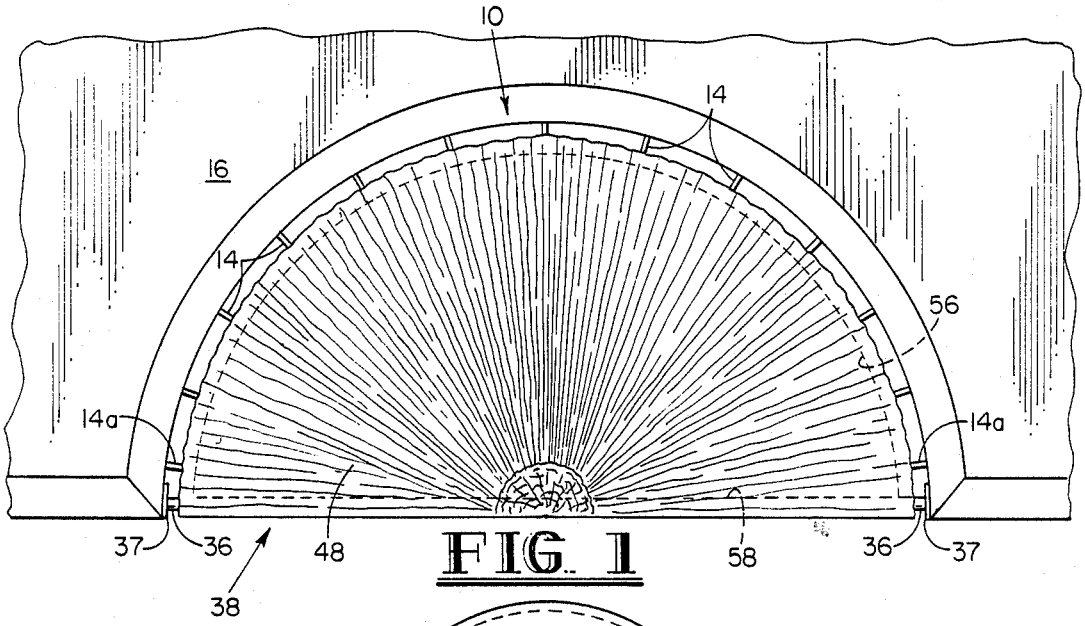
FIG. 1 is a front view of the curtain assembly installed in an arched window.

Referring to FIG. 1, the drapery assembly is referred to generally by the reference numeral 10. Unless otherwise indicated, the preferred embodiment discussed herein is for installation in an arched window 12 as depicted in FIG. 1.

Figure 2:
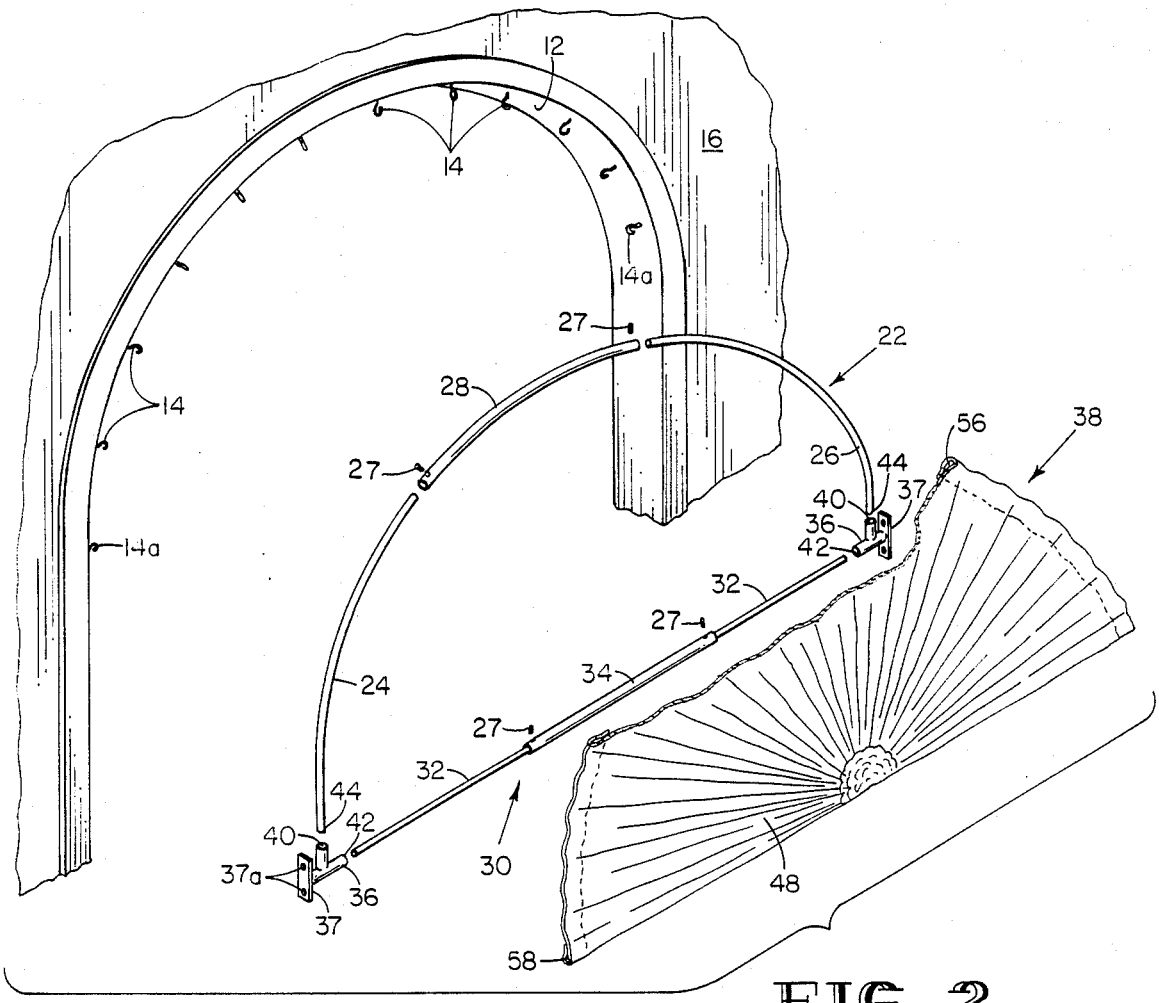
FIG. 2 is an exploded perspective of FIG. 1.

Referring to FIG. 2, the installed assembly 10 comprises a plurality of hooks 14 which are affixed to building material 16 adjacent to the portion of the window 12 which corresponds to the intended outer boundary of the installed assembly 10 (shown in FIG. 1). The hooks 14 are oriented perpendicular to the plane of the window 12 so that the eye 18 of each hook 14 is directed parallel with the plane of the window 12. Further, the breach 20 of each hook 14 should open to the face of the window 12 which is most visible to passers-by. The hooks 14 depicted in FIG. 2 are easily obtainable "cup hook" style hooks. The portion of each hook 14 which is threaded must be sufficiently long to securely engaged the building material 16. If correct placement of the hooks 14 requires that they be installed in materials such as sheet rock which usually lacks an underlying stable building material, a "molly bolt" type end (not shown) may be more appropriate for the hooks 14 than a threaded end. An alternative design for the portion of the hooks 14 which is not involved in engaging the building material 16 is discussed hereinafter.

Hooks 14 are used for the preferred embodiment instead of rod-end supporting hardware because the hooks 14 insure that the rod used to support the drapery (to be discussed hereinafter) is supported and maintained in a desired orientation along its entire length.

The drapery assembly 10 further comprises a first telescopic rod 22. The first rod 22 is, in the preferred embodiment, formed from three sections 24, 26 and 28 of flexible tubing, sections 24 and 26 being telescopically received within the section 28. Sections 24, 26, and 28 of the first rod 22 have diameters such that they can pass through the breach 20 and into the eye 18 of each hook 14.

Sections 24, 26, and 28 of the preferred embodiment are made from a synthetic, plastic-like material such as fiberglass, vinyl, or polyvinylchloride. Such materials are preferable because: 1) unlike most metal used for drapery rods, they are easily made to bend uniformly between points where pressure is applied thereby being ideal for achieving a uniform curvature such as for an arched window, 2) their smooth surfaces prevent damage to drapery fabric as the fabric moves across the rod surfaces during installation, and 3) unlike metal, they do not tend to buckle and become permanently deformed during the bending associated with installation.

The flexibility of the first rod 22 permits it to concurrently extend through the eye 18 of each hook 14 along the curved perimeter of the window 12. The flexibility of the first rod 22, along with the variable length permitted by its telescopic structure, permits it to conform to the size and shape of windows having a variety of non-standard sizes and shapes thereby acting as a traverse rod for such windows abrogating the need for specially fabricated traverse rod assemblies.

Figure 5:
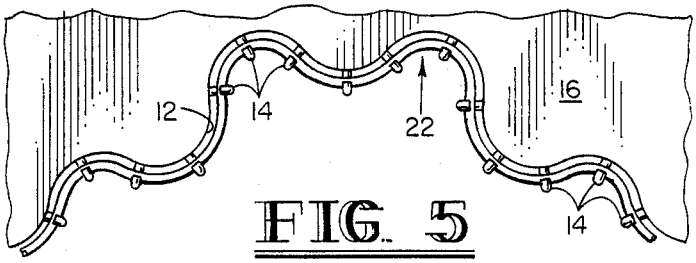
FIG. 5 shows the items of FIG. 4 properly arranged.

To prevent the sections 24 and 26 from accidentally separating from section 28 during installation or otherwise, a set screw 27 is placed near either end of section 28. When tightened, the respective set screw 27 presses against sections 24 and 26 and hold them in a desired position. This is particularly beneficial as the assembly is installed in apertures of more elaborate shape such as is shown in FIG. 5.

The preferred embodiment includes a second rod 30 which comprises two sections 32 and 34, section 32 being telescopically received within section 34. The sections 32 and 34 of the second rod 30 are formed from material which is substantially inflexible. Inflexibility of the second rod 30 is necessary so that it will not bend under pressure exerted by the flexed first rod 22. The second rod 30 will usually be of substantially the same diameter as the first rod 22. The variable length of the second rod 30 permits the second rod 30 to span between the elbow joints 36 and complete a framework for supporting the drapery 38. Section 34 also has a set screw 27 to maintain the second rod at a desired length.

Figure 4:
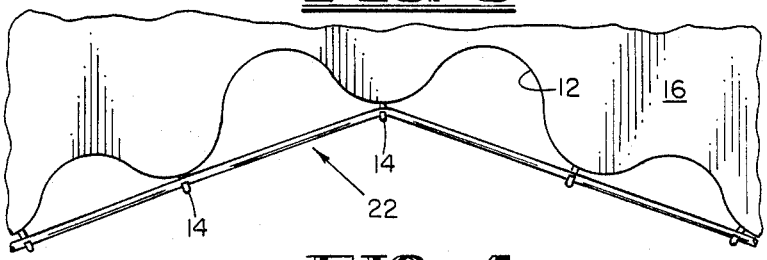
FIG. 4 shows portions of the drapery assembly arranged improperly for use in a non-uniformly curved window.

Referring again to FIG. 2, two elbow joints 36 are shown, each having two orifices 40 and 42. The purpose of the elbow joints 36 is to couple the first rod 22 with the second rod 30 by receiving the ends 44 of the first rod 22 in their respective orifices 40 and by receiving the ends 46 of the second rod 30 in their respective orifices 42. For installation in a simple arched window 12, the orifices 40 and 42 will be directed approximately 90 degrees relative to each other. For windows 12 having other shapes (as shown in FIGS. 4 and 5), the orifices 40 and 42 of the elbow joints 36 may need to be directed differently in order to properly couple the rods 22 and 30. For additional stability for the drapery assembly 10, the elbow joints 36 each include a mounting plate 37. The mounting plate 37 is attached to building material 16 by passing screws (not shown) through the holes 37*a* in the mounting plate 37.

Figure 3:
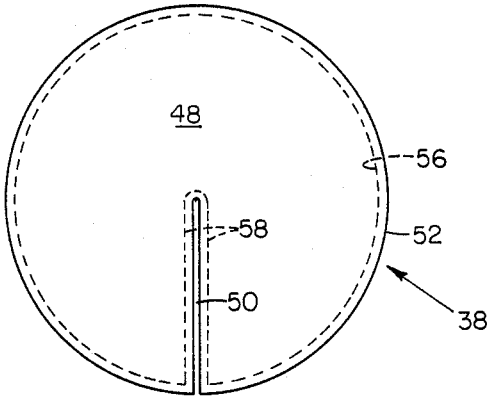
FIG. 3 depicts the drapery fabric used for the drapery assembly.

Referring to FIG. 3, the drapery 38 for an arched window 12 as shown in FIG. 1, is made from a circular piece of fabric 48 with a radial cut 50 extending from the fabric's 48 periphery 52 to its center 54. A heading casement 56 is formed near the fabric's 48 periphery 52. A continuous base casement 58 is formed in the fabric 48 adjacent to the cut 50. The dimensions of the fabric 48 are such that it will be held reasonably taut when the first rod 22 and the second rod 30, which respectively pass through the heading casement 56 and the base casement 58, are installed in the window 12. The precise dimensions, of course, will vary with each window which is to receive the drapery assembly 10.

It is noted that, at least for the arched window, the drapery 38 will itself maintain the first rod 22 in substantial conformity with the shape of the window 12 into which the assembly 10 will be installed. This is because the drapery's 38 periphery 52 is shaped to conform to the shape of the window 12 and, since the heading casement 56 follows this outer periphery 52, the heading casement 56 holds the first rod 22 in conformity with the shape of the window 12. Therefore, once the first rod 22 is extended to the proper length, the drapery 38 is made, and the two are put together, they may be very simply hung from the hooks 14 without any significant difficulty or maneuvering on the part of the person(s) installing the assembly 10.

Referring to FIGS. 4 and 5, the drapery assembly may be installed in windows 12 having more elaborately shaped perimeters than previously discussed. It is important to realize that the hooks 14 installed along the perimeter of such a window 12 may need to be more closely spaced than hooks 14 installed in windows 12 such as originally discussed herein.

Referring primarily to FIG. 2, the following steps in the listed sequence are involved in installing drapery according to the invention herein described:

1. Fashion a drapery 38 from appropriate drapery fabric 48. The drapery 38 is to include a heading casement 56 sized for permitting the first rod 22 to pass therethrough, a base casement 58 sized for permitting the second rod 30 to pass therethrough, and is to be sized and shaped so that it is held in the desired manner when it is installed in the window 12 along with the remaining components of the drapery assembly 10.

2. Affix the hooks 14 to the building material 16 along the portion of the window's 12 periphery which will ultimately adjoin the drapery 38, with the outermost hooks 14 being positioned approximately two inches inward from the points 60 on the window's 12 periphery which are adjacent to the desired outermost boundaries of the drapery 38 when installed.

3. Select a first flexible, telescopic rod 22 extendable to a length sufficient to pass through the eye 18 of each hook 14 and extend approximately two inches beyond the two outermost hooks 14 and extend the first rod 22 to this length.

4. Thread the first rod 22 through the drapery's 38 heading casement 56, distributing the fabric 48 evenly over the first rod 22 leaving approximately one inch of the first rod 22 exposed at either end of the heading casement 56.

5. Insuring that the drapery fabric 48 is evenly distributed over the first rod 22 and that the first rod 22 is extended to the proper length as described above, cut a slit 62 through one side of the heading casement 56 corresponding to the point where each hook 14 must pass through the fabric 48 to reach the first rod 22 when the assembly 10 is installed in the window 12. If the drapery 38 has intended presentation and hidden sides (not delineated in the drawings) the slits 62 should be made in though the hidden side. Each slit 62 should be no larger than is necessary to permit the hook 14 to pass therethrough when the assembly 10 is being installed. Designer tape (not shown) with slits 62 already formed therein at the appropriate locations may optionally be attached to the heading casement 56 to assist in proper placement of the slits 62 in the heading casement 56 and to reinforce the slits 62 against tearing.

6. Suspend the first rod 22 with the drapery 38 threaded thereon on the hooks 14 such that each hook 14 passes through the respective slit 62 in the drapery's 38 heading casement 56, the first rod 22 is supported as it resides in the eye 18 of each hook 14, and the first rod 22 extends approximately two inches beyond the two outermost hooks 14*a*.

7. Insert each end 44 of the first rod 22 into the first orifice 40 of an elbow joint 36 and orient the elbow joint 36 such that the orifice 42 of each elbow joint 36 face each other.

8. Select a second flexible, telescopic rod 30 extendable at a length sufficient to span across the window 12 between the elbow joints 36 and extend into the orifice 42 of each elbow joint 36.

9. Thread the second rod 30 through the base casement 58 of the drapery 38, evenly distributing the fabric 48 over the second rod 30, and insert each end 46 of the second rod 30 into the respective orifice 42 of each elbow joint 36.

Figure 6:
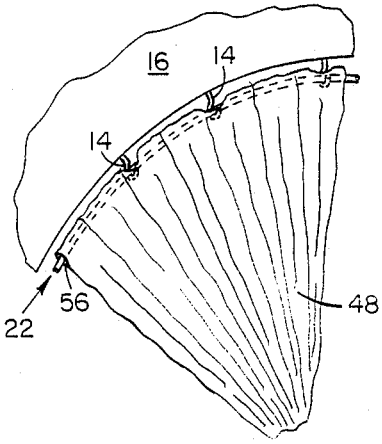
FIG. 6 shows a drapery assembly using standard "cup hook" style hooks.

Referring to FIG. 6, although the "cup hook" style hook 14 as shown above performs adequately for most applications, an alternative hook design may be preferably for certain other applications. As shown in FIG. 6, a "cup hook" style hook 14 which extends radially outward from the perimeter of the window 12 may disfigure the fabric 48 at the point where the hook 14 passes through the heading casement 56 to reach the first rod 22. If the drapery 38 which is to be installed in the window 12 lacks features, such as ruffles (not shown in FIG. 6) which may mask this deformation and cover the hook 14, this arrangement may be unacceptable from an aesthetic point of view.

Figure 7:
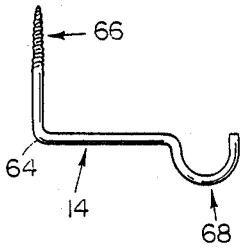
FIG. 7 depicts the specially designed hook for use with the drapery assembly of the present invention.
Figure 8:
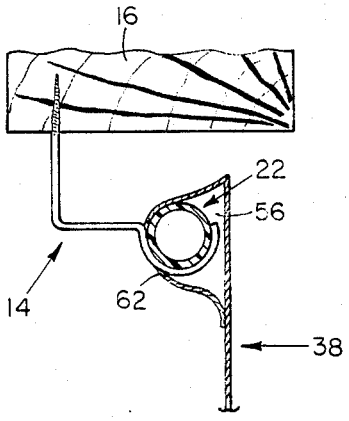
FIG. 8 shows a drapery assembly installed using a specially designed hook.

Referring in combination to FIGS. 7 and 8, an alternative design for the hook 14 includes a shank 64 which is bent to form a 90 degree angle, the shank 64 having a threaded first end 66 for threading into building material 16 as discussed above, and a crooked second end 68 for holding the first rod 22. As shown in FIG. 8, a hook 14 of this design eliminates visible deformation of the fabric 48 because it passes through the heading casement 56 on the hidden side of the drapery 38.

When the alternatively designed hooks 14 are used, they should be installed such that the crooked end 68 of each hook 14 points toward the most visible face of the window 12. With the hooks 14 in this orientation, they will pass through the heading casement 56 of the drapery 38 from the least visible side of the window 12 and will, therefore, be hidden from view for most purposes. In the case of a window 12 in an exterior wall (not shown) for example, the crooked ends 68 of the hooks 14 should point toward the interior of the room.

An acceptable alternative for the sectional, telescopic design for the first rod 22 and the second rod 30 involves using single segments of flexible fiberglass rod (not shown) which are cut to the appropriate size. The material to be used for this alternative embodiment may be most easily described as that used for the poles for bicycle caution flags (not shown).

Installation of the drapery assembly 10 using single-piece rods 22 and 30 will simply involve measuring the length appropriate for the first rod 22 and the second rod 30 and cutting the rods 22 and 30 from larger pieces accordingly. The length for the first rod 22 will be substantially equal to the distance, as measured along the window's 12 periphery, between the points 60 which are adjacent to the intended outer boundaries of the drapery 38 when the drapery assembly 10 is ultimately installed. The length of the second rod 30 will be equal to the distance between the two elbow joints 36 positioned on the ends 44 of the installed first rod 22 such that the ends 46 of the second rod 30 extend into the orifice 42 of the respective elbow joint 36.

A use of the present invention in addition to those uses already discussed involves creating the impression of an arched window where there is no such window (not illustrated in the drawings). This simply involves placing the hooks 14 on a wall in the pattern desired, fashioning an appropriately sized and shaped drapery 38, engaging the first rod 22 and the second rod 30 with the drapery 38, attaching the elbow joints 36, and hanging the assembly 10 by the hooks 14.

The present invention, as just-described, teaches and apparatus and method for providing drapery for windows and passageways having non-standard peripheral shapes, the practice of which invention permits substantial monetary savings as compared to presently-implemented apparatus and methods.

Although the invention has been described with reference to specific embodiments, this description is not meant to be construed in a limiting sense. Various modifications of the disclosed embodiment, as well as alternative embodiments of the invention will become apparent to persons skilled in the art upon reference to the description of the invention. It is therefore contemplated that the appended claims will cover such modifications that fall within the true scope of the invention.

I claim:

1. A drapery assembly for installation in and conformity with an architectural aperture of non-standard size and shape comprising:

a flexible, telescopic first rod extendable and retractable to a length sufficient to conform to a section of said aperture's periphery from which the installed said assembly is to be suspended and to span between the outermost boundaries of said section, said first rod having means for preventing accidental change in length of said first rod during and after installation;

a plurality of hooks to be fixed to building material along said section of said perimeter, said hooks having eyes sized for allowing said first rod to extend therethrough;

a drapery having a heading casement through which said first rod extends, said heading casement having slits corresponding in number and relative position to said hooks when fixed to said building material whereby each said hook extends through said slit and engages and supports said first rod, said drapery being sized and shaped to maintain said first rod in said installed assembly in a shape conforming to said section of said periphery by exerting a restraining force on said first rod, said drapery with said rod passing through said heading casement having the proper size and shape for being suspended by said hooks fixed to said building material and thereby providing means for dressing architectural apertures having non-standard sizes and shapes without the necessity for custom fabrication of a traverse rod or mounting hardware, said drapery further having a base casement through which a second rod may extend to maintain said drapery in a desired orientation and further comprising:

a substantially non-flexible, telescopic second rod, said second rod being extendable to a second length sufficient to extend in a straight line across said aperture between said outermost boundaries; and first and second elbow joints each having first and second orifices oriented ninety degrees relative to each other, said first orifices being sized for receiving said first rod's ends when inserted therein, said second orifices being sized for receiving said second rod's ends when inserted therein, said elbow joints for coupling said first and second rods and thereby providing internal stability for said assembly, each said elbow joint further having a mounting plate with screwholes therethrough for attaching said elbow joints to said building material to further attach said assembly to said building material.

2. The invention of claim 1 wherein said hooks each have a shank formed into approximately a 90 degree angle whereby, when a threaded end of said hook passes into said building material in a direction parallel with the plane of said aperture, a crooked end of said hook approaches said first rod through said drapery at a direction perpendicular to said plane of said aperture thereby reducing visibility of said hook and deformation of said drapery where said hook passes through said heading casement.

3. The invention of claim 1 wherein said first and second rods each comprise two or more telescopically engaged tubular members made from a synthetic, plastic-like material having a smooth surface, said composition for preventing damage to fabric forming said drapery, and, for said first rod which has a thickness whereby said first rod is flexible, for achieving uniform curvature of said first rod, said second rod being formed to be substantially non-flexible.

4. A drapery kit for covering a portion of an arched window comprising:

a plurality of hooks, each having an eye and a breach opening into said eye, a shank, and a threaded end opposite said eye for attaching said hook to building material;

a first flexible, telescopic rod having first and second ends and being sized and shaped for passing through said breach and residing in said eye of each of said hooks, said first rod being extendable to a first length whereby said first rod may extend along the curved periphery of said arched window through said eyes of said hooks between outermost boundaries of said portion of said window;

a second substantially non-flexible, telescopic rod wit third and fourth ends, said second rod being extendable to a second length sufficient to extend in a straight line across said window whereby said third and fourth ends reach said outermost boundaries;

a drapery having a heading casement sized for permitting said first rod to extend therethrough and a base casement sized for permitting said second rod to pass therethrough, said drapery being sized and shaped so that said drapery covers said portion of said window and maintains said first rod in a shape corresponding to the shape of said portion of said periphery; and first and second elbow joints each having first and second orifices oriented ninety degrees relative to each other, said first orifices being sized for receiving said first and second ends of said first rod, said second orifices being sized for receiving said third and fourth ends of said second rod, said elbow joints for coupling said first and second rods and thereby providing internal stability for said assembly, each said elbow joint further having a mounting plate with screwholes therethrough for attaching said elbow joints to said building material to further attach said assembly to said building material;

said hooks, first and second rods, drapery, and elbow joints collectively providing means for dressing arched windows of varying sizes and curvatures without the necessity for custom fabrication of components other than said drapery.

5. The invention of claim 4 wherein said hooks each have a shank formed into approximately a 90 degree angle whereby, when a threaded end of said hook passes into said building material in a direction parallel with the plane of said window, a crooked end of said hook approaches said first rod through said drapery at a direction perpendicular to said plane of said aperture thereby reducing visibility of said hook and deformation of said drapery where said hook passes through said heading casement.

6. A drapery assembly covering a portion of an architectural aperture having a curved perimeter, comprising:

a plurality of hooks affixed to building material surrounding said aperture, said hooks being evenly distributed over a portion of said building material from which said drapery is suspended, each said hook having an eye defining an axis through the opening thereof a breach opening into said, eye, a threaded end engaged with said building material, and a shank extending between said threaded end and said eye, all of said hooks being oriented whereby the axis through each of said eyes is directed parallel to said window's plane and their said breaches open to a same face of said aperture;

a flexible telescopic first rod made from a non-metallic, synthetic material, said first rod having ends and further extending through said eye of each said hook and extending adjacent to the full length of said portion of said building material from which said drapery is suspended;

a flexible telescopic second rod having ends; means for coupling said first rod to said second rod; and a drapery having a heading casement through which said first rod extends, said heading casement having a plurality of slits through which said eye of each of said hooks respectively extends from outside of said heading casement to engage said first rod inside of said heading casement, said drapery being sized and shaped so, when said first rod passes through said heading casement with said drapery being evenly distributed on said first rod and when said first rod is engaged with said hooks, said drapery covers a desired part of said window providing a desired appearance;

said drapery assembly providing means for suspending drapery conformable to curved perimeters of architectural apertures.

7. The invention of claim 6 wherein said second rod's ends being coupled with respective said first rod's ends by elbow joints, each said elbow joint having first and second orifices which respectively receive an end of said first and said second rods, each said elbow joint further having a mounting plate with screws therethrough attached to said building material for providing stability for said assembly.

8. The invention of claim 7 wherein said drapery has a base casement through which said second rod extends for maintaining portions of said drapery adjacent to said second rod in conformity with said second rod's shape and orientation.

9. The invention of claim 7 wherein said first and second rods each comprise two or more segments in a telescopic arrangement whereby said rods are extendable to varying lengths and are thereby useful in architectural apertures of varying dimensions and wherein said first and said second rods each further comprise means to prevent said segments from unintentionally changing length during or after installation.

10. The invention of claim 8 wherein said first and second rods comprise two or more segments in a telescopic arrangement whereby said rods are extendable to varying lengths and are thereby useful in architectural apertures of varying dimensions.

11. The invention of claim 7 wherein said hooks each have a shank formed into approximately a 90 degree angle whereby, when a threaded end of said hook passes into said building material in a direction parallel with the plane of said aperture, a crooked end of said hook approaches said first rod through said drapery at a direction perpendicular to said plane of said aperture thereby reducing visibility of said hook and deformation of said drapery where said hook passes through said heading casement.

12. A drapery assembly covering a portion of an architectural aperture having a curved periphery comprising:

a plurality of hooks, each having an eye and a breach opening into said eye, a shank, and a threaded end opposite said eye affixed to building material along said periphery of said aperture, said hooks being evenly spaced along said periphery bounding said portion and being uniformly oriented whereby said eye of each said hook faces a direction parallel with the plane of said aperture and said breach of each said hook opens to a same side of said aperture, the outermost of said hooks being placed approximately two inches from outermost boundaries of said portion;

a first flexible, telescopic rod having first and second ends and residing in said eye of each of said hooks, said first rod being extended to a first length whereby said first rod extends beyond said outermost hooks whereby said first and second ends reside adjacent to said outermost boundaries of said portion;

a second substantially non-flexible, telescopic rod with third and fourth ends and being extended to a second length and spanning across said aperture between said outermost boundaries;

a drapery having a heading casement through which said first rod extends and a base casement through which said second rod extends, said drapery being sized and shaped whereby no more than approximately one inch of said first and second ends must extend from said heading casement, no more than approximately one inch of said third and fourth ends must extend from said base casement, and whereby said drapery covers said portion of said aperture and provides a desired appearance, said heading casement having a plurality of slits positioned so each said hook may respectively extend from outside of said heading casement to engage said first rod inside said heading casement; and first and second elbow joints each having first and second orifices, said first orifice of each said elbow joint respectively receiving said first and second ends and said second orifice of each said elbow joint respectively receiving said third and fourth ends, said elbow joints each having a mounting plate with screwholes therethrough attached to said building material and thereby stabilizing said assembly.

* * * * *